US005176549A

United States Patent [19]

Ross

[11] Patent Number: 5,176,549

[45] Date of Patent: Jan. 5, 1993

[54] MARINE STEERING APPARATUS

[75] Inventor: Edgar Ross, Glencoe, Ill.

[73] Assignee: Outboard Marine Corporation, Waukegan, Ill.

[21] Appl. No.: 736,476

[22] Filed: Jul. 26, 1991

[51] Int. Cl.[5] ..... B63H 5/12

[52] U.S. Cl. ..... 440/62; 440/63; 440/900

[58] Field of Search ..... 440/53, 52, 61, 62, 440/63, 900; 114/144 R, 146

[56] References Cited

U.S. PATENT DOCUMENTS

| | | | |
|---|---|---|---|
| 1,774,848 | 9/1930 | Russell | 440/63 |
| 2,514,467 | 7/1950 | Black | 114/146 |
| 2,543,553 | 2/1951 | McAllister | 115/18 |
| 2,895,445 | 7/1959 | Foraker | 115/18 |
| 3,143,995 | 8/1964 | Koppen | 115/37 |
| 3,382,838 | 5/1968 | Bergstedt | 440/63 |
| 4,496,326 | 1/1985 | Boda | 440/62 |
| 4,693,689 | 9/1987 | Haroda | 440/62 |
| 4,919,629 | 4/1990 | Isogawa et al. | 440/62 |

*Primary Examiner*—Edwin L. Swinehart
*Attorney, Agent, or Firm*—Michael, Best & Friedrich

[57] ABSTRACT

An apparatus for mounting a propulsion unit to a boat, the apparatus comprising structure for connecting the propulsion unit to the boat for pivotal movement relative thereto about a generally vertical steering axis, a tiller handle pivotally mounted on the connecting structure independently of the propulsion unit, and structure for pivoting the propulsion unit in response to pivotal movement of the tiller handle.

19 Claims, 2 Drawing Sheets

MARINE STEERING APPARATUS

BACKGROUND OF THE INVENTION

1. Field of the Invention

This invention relates to marine propulsion devices, and more particularly to apparatus for steering marine propulsion devices.

2. Description of the Prior Art

It is known to steer twin outboard motors by a steering lever extending forwardly from the transom. The steering lever is connected to the motors by rods which are connected to brackets extending from the motors.

Attention is directed to the following U.S. patents:

| | | |
|---|---|---|
| Russell | 1,774,848 | September 2, 1930 |
| McAllister | 2,543,553 | February 27, 1951 |
| Foraker | 2,895,445 | July 21, 1959 |
| Koppen | 3,143,995 | August 11, 1964 |
| Isogawa, et al. | 4,919,629 | April 24, 1990 |

SUMMARY OF THE INVENTION

The invention provides an apparatus for mounting a propulsion unit to a boat, the apparatus comprising means for connecting the propulsion unit to the boat for pivotal movement relative thereto about a generally vertical steering axis, a tiller handle pivotally mounted on the connecting means independently of the propulsion unit, and means for pivoting the propulsion unit in response to pivotal movement of the tiller handle.

One embodiment of the invention provides a marine apparatus for use with a propulsion unit connected to a boat for pivotal movement relative thereto about a generally vertical steering axis, the apparatus comprising a tiller handle adapted to be pivotally mounted on the boat, and cable means connected to the tiller handle and adapted to be connected to the propulsion unit for causing pivotal movement of the propulsion unit in response to pivotal movement of the tiller handle.

One embodiment of the invention provides a marine propulsion device comprising a transom bracket adapted to be fixed to the transom of a boat, a swivel bracket mounted on the transom bracket for pivotal movement relative thereto about a generally horizontal tilt axis, a propulsion unit mounted on the swivel bracket for pivotal movement relative thereto about a generally vertical steering axis, a tiller handle mounted on the transom bracket for pivotal movement relative thereto and independently of the propulsion unit, and means for pivoting the propulsion unit about the steering axis in response to pivotal movement of the tiller handle.

A principal feature of the invention is the provision of an outboard motor with a tiller handle mounted either on the transom bracket or on a remote bracket. This minimizes vibration of the tiller handle, because the tiller handle is mounted on a member that is fixed directly to the boat.

Other features and advantages of the invention will become apparent to those of ordinary skill in the art upon review of the following detailed description, claims, and drawings.

Figure 1:
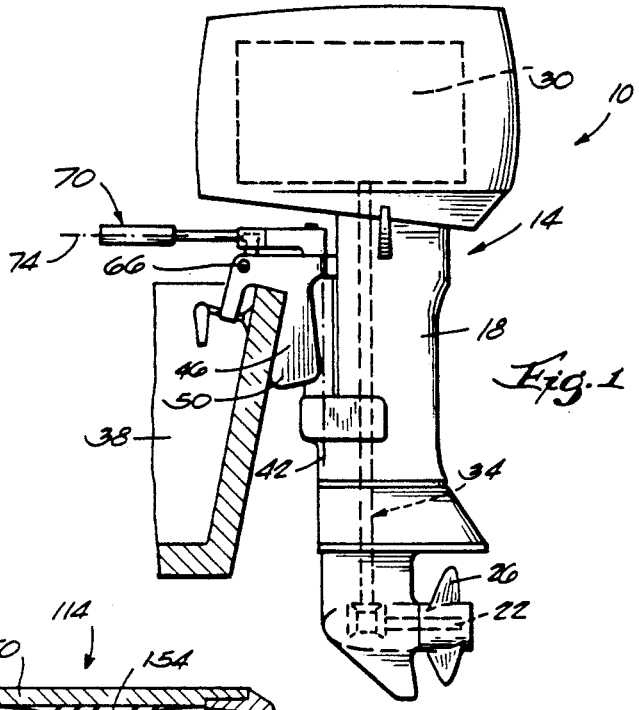
FIG. 1 is a side elevational view of a marine propulsion device embodying the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Figure 3:
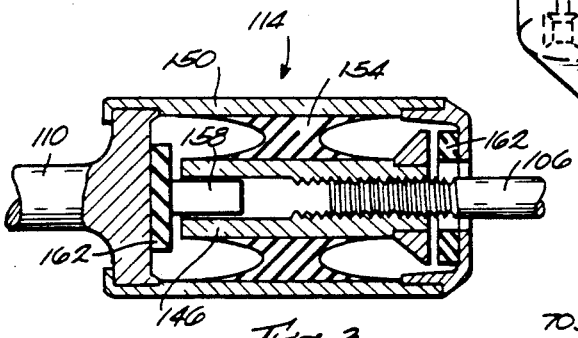
FIG. 3 is a partial sectional view of the device.
Figure 2:
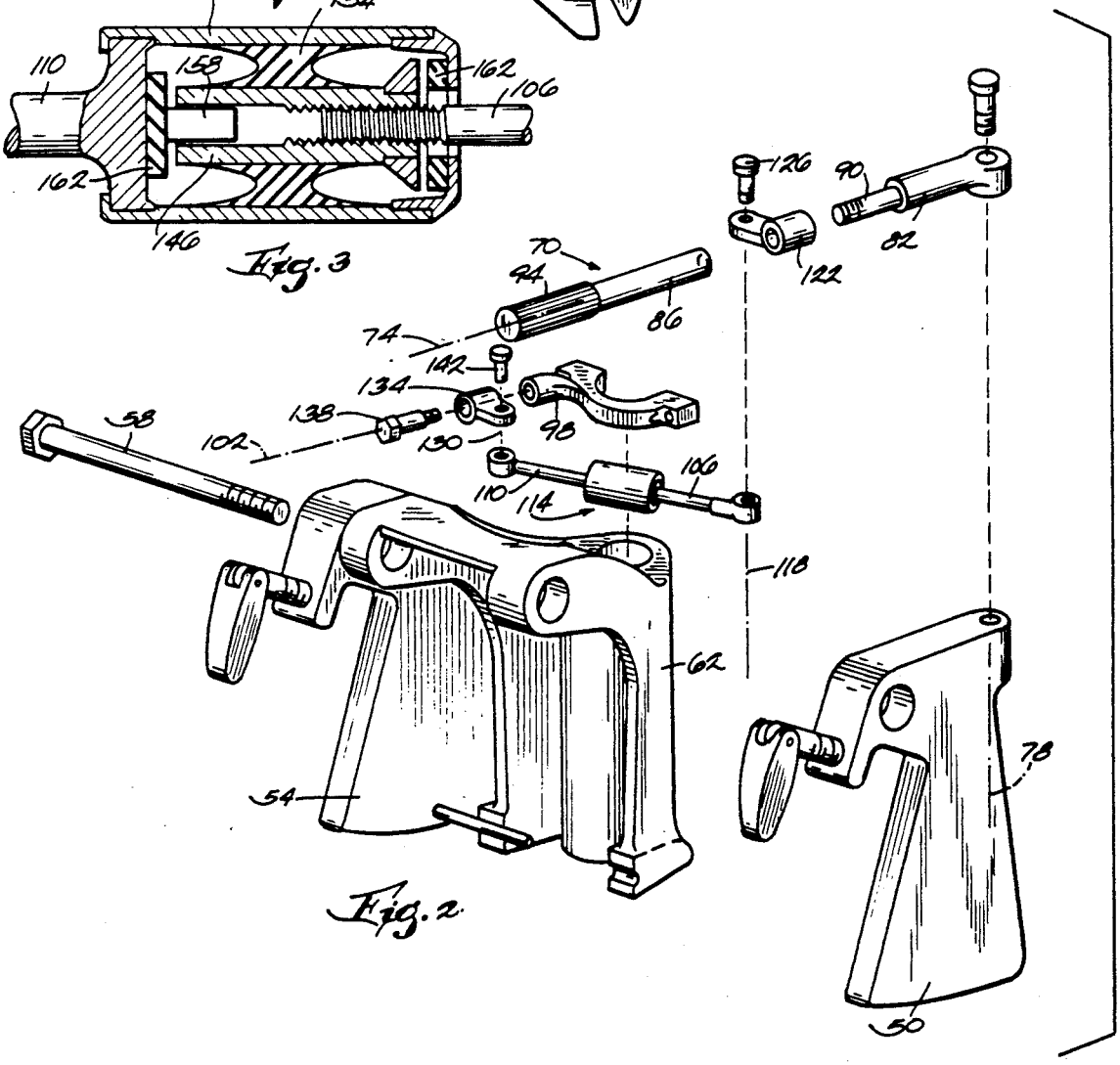
FIG. 2 is a partial, exploded perspective view of the device.

A marine apparatus 10 embodying the invention is illustrated in FIGS. 1-3. The marine apparatus 10 comprises a marine propulsion device which, in the illustrated construction, is an outboard motor 14.

The outboard motor 14 includes a conventional propulsion unit 18. The propulsion unit 18 includes a propeller shaft 22 supporting a propeller 26, and an engine 30 drivingly connected to the propeller shaft 22 by a drive train 34. The outboard motor 14 also includes means for connecting the propulsion unit 18 to a boat 38 for pivotal movement relative thereto about a generally vertical steering axis 42. While various suitable connecting means can be employed, in the illustrated construction, such means includes a transom bracket 46 fixed to the transom of the boat 38. The transom bracket 46 includes (see FIG. 2) spaced-apart port and starboard clamp portions 50 and 54, and a tilt member 58 supported by and extending between the clamp portions 50 and 54. The connecting means also includes a swivel bracket 62 connected to the transom bracket 46 for pivotal movement relative thereto about a generally horizontal tilt axis 66 (FIG. 1). In the illustrated construction, the swivel bracket 62 is pivotally mounted on the tilt member 58. The propulsion unit 18 is mounted on the swivel bracket 62 for pivotal movement relative thereto about the steering axis 42.

The marine apparatus 10 also comprises (see FIGS. 1 and 2) a tiller handle 70 pivotally mounted on the transom bracket 46 independently of the propulsion unit 18. The tiller handle 70 has a horizontally extending longitudinal axis 74. Preferably, as shown in FIG. 2, the tiller handle 70 is mounted on the port clamp portion 50 for pivotal movement relative thereto about a generally vertical axis 78, and the tiller handle 70 includes a rearward section 82 and a forward section 86. The rearward end of the rearward section 82 is pivotally connected to the transom bracket 46, and the forward end of the rearward section 82 includes a forwardly extending, reduced-diameter portion 90. The rearward end of the forward section 86 is threaded onto the reduced-diameter portion 90 of the rearward section 82, and the forward end of the forward section 86 has thereon a grip or handle 94.

The marine apparatus 10 also comprises (see FIG. 2) means for pivoting the propulsion unit 18 in response to pivotal movement of the tiller handle 70. While various suitable means can be used, in the illustrated construction, such means includes a steering arm 98 which extends forwardly from the propulsion unit 18 and which is fixed to the propulsion unit 18 for common movement therewith. The steering arm 98 has a horizontally extending longitudinal axis 102. The pivoting means also includes link means having one end connected to the tiller handle 70 and an opposite end connected to the steering arm 98. In the illustrated construction, as shown in FIGS. 2 and 3, the link means includes first and second link portions 106 and 110 and vibration absorbing means 114 connecting the link portions 106 and 110.

The first link portion 106 is connected to the tiller handle 70 for pivotal movement relative thereto about the longitudinal axis 74 of the tiller handle 70 and also about a vertical axis 118 perpendicular to the longitudinal axis 74. Preferably, a collar member 122 is mounted on the reduced-diameter portion 90 of the tiller handle 70 for pivotal movement relative thereto about the longitudinal axis 74, and the first link portion 106 is pivotally connected to the collar member 122 by a pin 126 for pivotal movement relative to the collar member 122 about the axis 118.

The second link portion 110 is connected to the steering arm 98 for pivotal movement relative thereto about the longitudinal axis 102 of the steering arm 98 and also about a vertical axis 130 perpendicular to the longitudinal axis 102. Preferably, a collar member 134 is pivotally connected to the forward end of the steering arm 98 by a bolt or pin 138 for pivotal movement relative to the steering arm 98 about the longitudinal axis 102, and the second link portion 110 is connected to the collar member 134 by a pin 142 for pivotal movement relative to the collar member about the axis 130.

The vibration absorbing means 114 includes (see FIG. 3) a tubular member 146 threaded onto the first link portion 106, an annular sleeve 150 which is fixed to the second link portion 110 and which surrounds the tubular member 146, and an annular elastic member 154 surrounding the tubular member 146 and connecting the tubular member 146 to the sleeve 150. As shown in FIG. 3, the second link portion 110 includes a cylindrical projection 158 which extends within the tubular member 146 and which is normally spaced from the tubular member 146. The cylindrical projection 158 will, however, engage the tubular member 146 in the event of excessive misalignment of the link portions 106 and 110 so as to prevent further misalignment of the link portions 106 and 110. Elastic rings 162 on either end of the tubular member 146 prevent excessive movement of the tubular member 146 relative to the sleeve member 150. Under normal operating conditions, the first link portion 106 is connected to the second link portion 110 only by the member 146, elastic member 154, and the sleeve 150. The elastic member 154 thus reduces vibration of the tiller handle 70 caused by vibration of the propulsion unit 18.

When the tiller handle 70 is pivoted in one direction relative to the transom bracket 46, the link means causes pivotal movement of the steering arm 98 and thereby the propulsion unit 18 in the same direction relative to the swivel bracket 62. Vibration of the tiller handle 70 is minimized by the vibration absorbing means 114 and by the pivotal connection of the tiller handle 70 to the transom bracket 46 rather than to the propulsion unit 18. The pivotal connections between the link means and the tiller handle 70 and between the link means and the steering arm 98 allow for relative movement between the tiller handle 70 and the steering arm 98 due to pivotal movement of the propulsion unit 18 about the steering axis 42 and pivotal movement of the propulsion unit 18 about the tilt axis 66.

Figure 4:
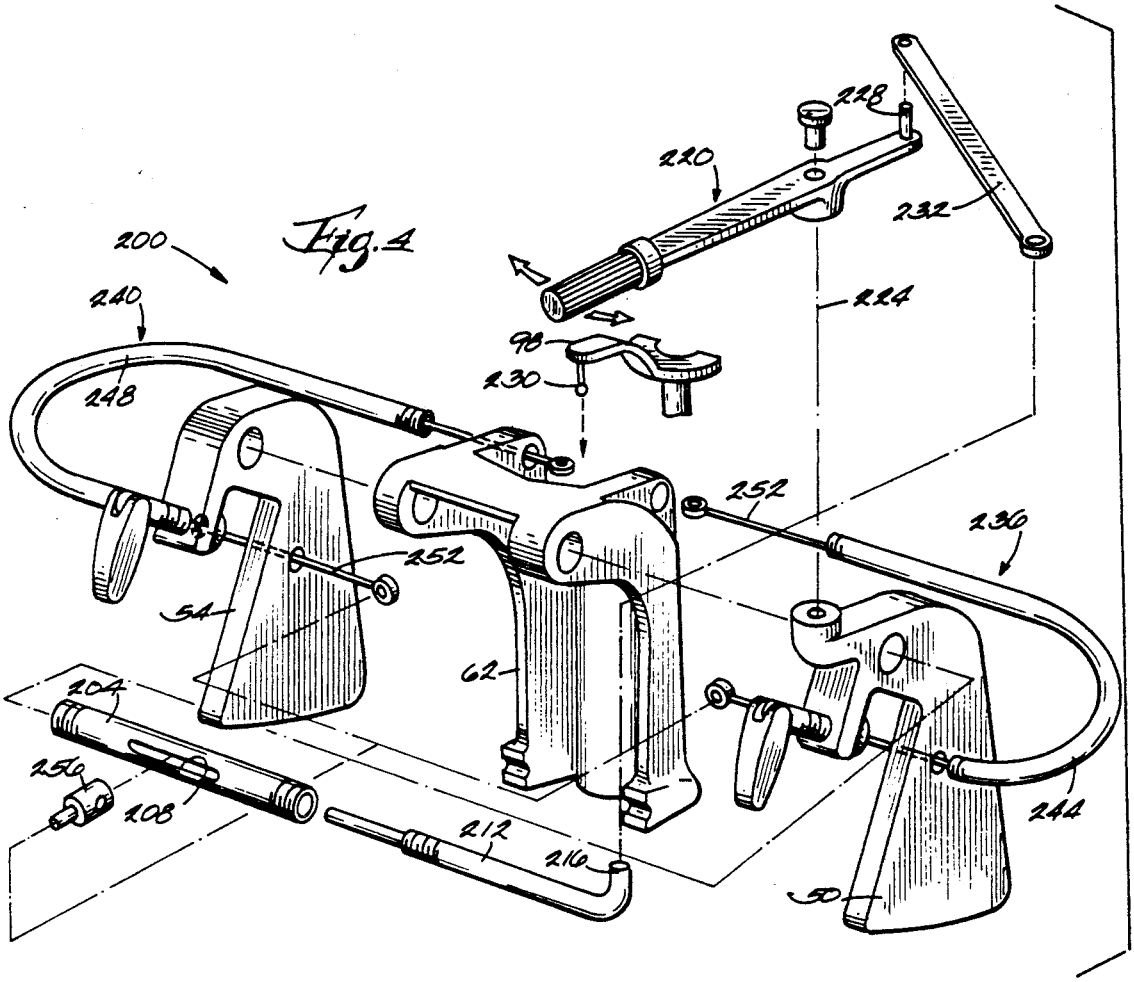
FIG. 4 is an exploded perspective view of an alternative embodiment of the invention.

A marine apparatus 200 that is an alternative embodiment of the invention is illustrated in FIG. 4. Except as described below, the marine apparatus 200 is substantially identical to the marine apparatus 10, and common elements have been given the same reference numerals.

In the marine apparatus 200, the transom bracket 46 includes a tilt tube 204 extending between the clamp portions 50 and 54, and the swivel bracket 62 is pivotally mounted on the tilt tube 204. The tilt tube 204 has therein a longitudinally extending slot 208, the reason for which is explained below.

The apparatus 200 also comprises an elongated member 212 slidably housed within the tilt tube 204. The elongated member 212 has an upwardly extending end portion 216 located exteriorly of the tilt tube 204. The reason for the end portion 216 is explained below.

Instead of the tiller handle 70 of the marine apparatus 10, the marine apparatus 200 comprises a tiller handle 220 mounted on the port clamp portion 50 for pivotal movement relative thereto about a generally vertical axis 224. The axis 224 intersects the tiller handle 220 at a point intermediate the ends of the tiller handle 220. The rearward end of the tiller handle 220 has thereon an upwardly extending pin 228, and the steering arm 98 has thereon a downwardly extending projection 230.

The marine apparatus 200 also comprises means for moving the elongated member 212 relative to the tilt tube 204 in response to pivotal movement of the tiller handle 220. While various suitable means can be employed, in the illustrated construction, such means includes a link 232 connected between the tiller handle 220 and the elongated member 212. The link 232 has one end pivotally connected to the pin 228 on the tiller handle 220 and an opposite end pivotally connected to the upwardly extending portion 216 of the elongated member 212.

The marine apparatus 200 also comprises cable means connected to the tiller handle 220 and to the propulsion unit 18 for causing pivotal movement of the propulsion unit 18 about the steering axis 42 in response to pivotal movement of the tiller handle 220. In the illustrated construction, the cable means includes port and starboard cables 236 and 240. The port cable 236 includes a sheath 244 having one end fixedly connected to the port clamp portion 50 and an opposite end fixedly connected to the swivel bracket 62. The starboard cable 240 includes a sheath 248 having one end fixedly connected to the starboard clamp portion 54 and an opposite end fixedly connected to the swivel bracket 62. Each of the cables 236 and 240 also includes a core 252 which is slidably housed by the associated sheath and which has a rearward end connected to the projection 230 on the steering arm 98 for common movement therewith and a forward end connected to the elongated member 212 for common movement therewith. In the illustrated construction, the forward ends of the cable cores 252 are connected to a member 256 which is threaded onto the elongated member 212 and which extends through the slot 208 in the tilt tube 204.

Pivotal movement of the tiller handle 220 in one direction acts through the link 232, the elongated member 212 and the cables 236 and 240 to cause pivotal movement of the steering arm 98 and thereby the propulsion unit 18 in the same direction. The cables 236 and 240 allow for pivotal movement of the swivel bracket 62 relative to the transom bracket 46.

Figure 5:
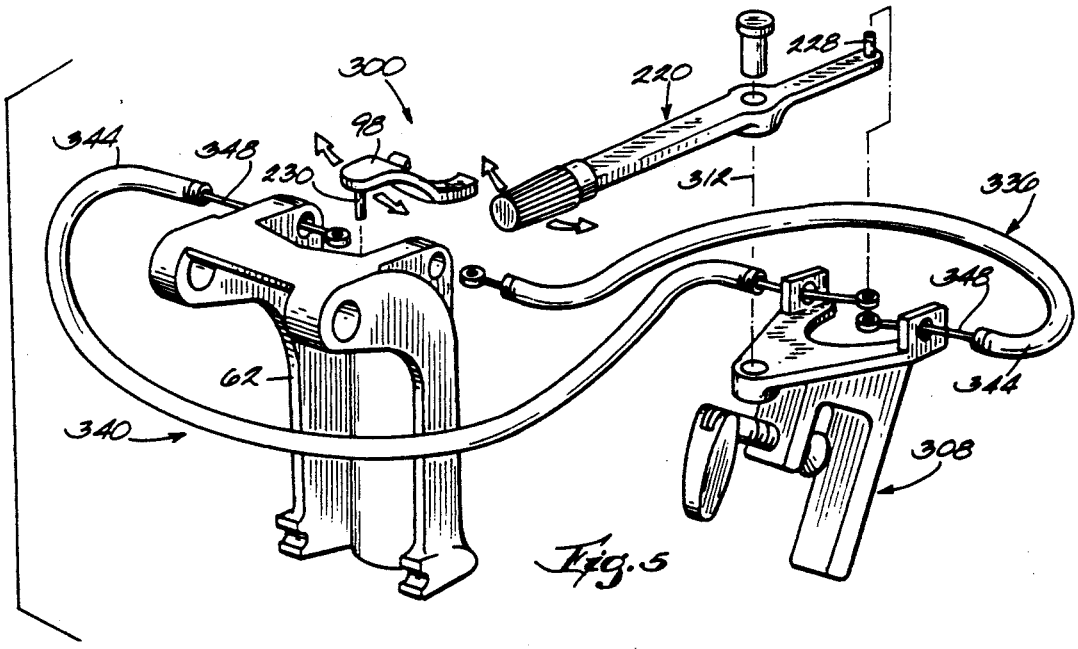
FIG. 5 is an exploded perspective view of a second alternative embodiment of the invention.

A marine apparatus 300 which is a second alternative embodiment of the invention is illustrated in FIG. 5. Except as described below, the marine apparatus 300 is substantially identical to the marine apparatus 200, and common elements have been given the same reference numerals.

In the marine apparatus 300, the tiller handle 220 is mounted on the boat remotely from the transom bracket 46, and the marine apparatus 300 comprises cable means for causing pivotal movement of the propulsion unit 18 in response to pivotal movement of the tiller handle 220.

More particularly, the marine apparatus 300 comprises a tiller bracket 308 which is fixed to the boat remotely from the transom bracket 46. While the illustrated tiller bracket 308 is pivotally mounted on the transom, the tiller bracket 308 can also be mounted elsewhere on the boat. The tiller handle 220 is mounted on the tiller bracket 308 for pivotal movement relative thereto about a generally vertical axis 312. The cable means includes port and starboard cables 336 and 340. Each of the cables 336 and 340 includes a sheath 344 having one end fixedly connected to the tiller bracket 308 and an opposite end fixedly connected to the swivel bracket 62. Each of the cables 336 and 340 also includes a core 348 having one end connected to the pin 228 of the tiller handle 220 and an opposite end connected to the projection 230 on the steering arm 98.

Pivotal movement of the tiller handle 220 in one direction acts through the cables 336 and 340 to cause pivotal movement of the steering arm 98 and thereby the propulsion unit 18 in the same direction. The cables 336 and 340 allow for pivotal movement of the swivel bracket 62 relative to the transom. Vibration of the tiller handle 220 is minimized because the tiller handle 220 is mounted on the tiller bracket 308 rather than on the propulsion unit 18.

Various features of the invention are set forth in the following claims.

I claim:

1. An apparatus for mounting on a boat a propulsion unit including an internal combustion engine, said apparatus comprising means including a transom bracket for connecting the propulsion unit to the boat for pivotal movement relative thereto about a generally vertical steering axis, a tiller handle pivotally mounted on said transom bracket about an axis fixed relative to said transom bracket, and means connected to said tiller handle and adapted for connection to the propulsion unit for pivoting the propulsion unit in response to pivotal movement of said tiller handle.

2. A mounting apparatus as set forth in claim 1 wherein said connecting means includes a swivel bracket connected to said transom bracket for pivotal movement relative thereto about a generally horizontal tilt axis, and wherein said pivoting means includes a steering arm adapted to be fixed to the propulsion unit and connected to said swivel bracket for pivotal movement relative thereto about said steering axis, and link means having one end connected to said tiller handle and an opposite end connected to said steering arm.

3. A mounting apparatus as set forth in claim 2 wherein said steering arm has a longitudinal axis, and wherein said opposite end of said link means is connected to said steering arm for pivotal movement relative thereto about said longitudinal axis and also about an axis perpendicular to said longitudinal axis.

4. A mounting apparatus as set forth in claim 2 wherein said tiller handle has a longitudinal axis, and wherein said one end of said link means is connected to said tiller handle for pivotal movement relative thereto about said longitudinal axis and also about an axis perpendicular to said longitudinal axis.

5. A mounting apparatus as set forth in claim 2 wherein said link means includes vibration absorbing means.

6. A mounting apparatus as set forth in claim 5 wherein said link means includes first and second link portions, and wherein said vibration absorbing means includes an elastic member connecting said link portions.

7. A mounting apparatus as set forth in claim 1 wherein said pivoting means includes cable means connected to said tiller handle and adapted to be connected to the propulsion unit.

8. A mounting apparatus as set forth in claim 7 wherein said connecting means further includes a swivel bracket connected to said transom bracket for pivotal movement relative thereto about a generally horizontal tilt axis, and wherein said pivoting means includes a steering arm adapted to be fixed to the propulsion unit and connected to said swivel bracket for pivotal movement relative thereto about said steering axis, and wherein said cable means is connected to said steering arm.

9. A marine apparatus for use with a propulsion unit which includes an internal combustion engine and which is adapted to be mounted on a boat transom for pivotal movement relative thereto about a generally vertical steering axis, said apparatus comprising a tiller handle adapted to be mounted for pivotal movement about a fixed axis extending through a member including means for attachment to the boat transom, a cable means connected to said tiller handle and adapted to be connected to the propulsion unit for causing pivotal movement of the propulsion unit in response to pivotal movement of said tiller handle.

10. A marine apparatus as set forth in claim 9 and further comprising a transom bracket adapted to be fixed to the boat transom, and a swivel bracket connected to said transom bracket for pivotal movement relative thereto about a generally horizontal tilt axis and adapted to support the propulsion unit for pivotal movement about the steering axis, and wherein said member comprises a tiller bracket which is remote from said transom bracket, and wherein said tiller handle is mounted on said tiller bracket.

11. A marine apparatus as set forth in claim 10 wherein said cable means includes a core having one end fixed to said tiller handle and an opposite end adapted to be fixed to the propulsion unit, and a sheath surrounding said core and having one end fixed to said tiller bracket and an opposite end fixed to said swivel bracket.

12. A marine apparatus as set forth in claim 9 wherein said member comprises a transom bracket, and further including a swivel bracket connected to said transom bracket for pivotal movement relative thereto about a generally horizontal tilt axis and adapted to support the propulsion unit for pivotal movement about the steering axis, and wherein said tiller handle is mounted on said transom bracket.

13. A marine apparatus as set forth in claim 12 wherein said cable means includes a core having one end connected to said tiller handle and an opposite end adapted to be fixed to the propulsion unit, and a sheath surrounding said core and having one end fixed to said transom bracket and an opposite end fixed to said swivel bracket.

14. A marine apparatus as set forth in claim 13 and further comprising a member slidably supported by said transom bracket, and means for moving said member relative to said transom bracket in response to pivotal movement of said tiller handle, and wherein said one end of said core is connected to said member.

15. A marine apparatus as set forth in claim 14 and further comprising a tilt tube supported by said transom bracket, wherein said swivel bracket pivots about said tilt tube, and wherein said member is slidably supported within said tilt tube.

16. A marine apparatus as set forth in claim 14 wherein said means for moving said member includes a link connected between said tiller handle and said member.

17. A marine propulsion device comprising a transom bracket adapted to be fixed to the transom of a boat, a swivel bracket mounted on said transom bracket for pivotal movement relative thereto about a generally horizontal tilt axis, a propulsion unit mounted on said swivel bracket for pivotal movement relative thereto about a generally vertical steering axis, a tiller handle mounted on said transom bracket for pivotal movement relative thereto about an axis fixed relative to said transom bracket, and means for pivoting said propulsion unit about said steering axis in response to pivotal movement of said tiller handle.

18. A marine propulsion device as set forth in claim 17 wherein said means for pivoting said propulsion unit includes a link connected between said tiller handle and said propulsion unit.

19. A marine propulsion device as set forth in claim 17 wherein said means for pivoting said propulsion unit includes cable means connected between said tiller handle and said propulsion unit.

* * * * *

UNITED STATES PATENT AND TRADEMARK OFFICE

CERTIFICATE OF CORRECTION

PATENT NO. : 5,176,549

DATED : January 5, 1993

INVENTOR(S) : Edgar Rose

It is certified that error appears in the above-identified patent and that said Letters Patent is hereby corrected as shown below: On the title page:

[19] Inventor "Rose"

[75] Inventor: Edgar Rose, Glencoe, ILL.

Signed and Sealed this

Twenty-sixth Day of October, 1993

*Attest:*

*Attesting Officer*

Bruce Lehman

BRUCE LEHMAN

*Commissioner of Patents and Trademarks*